United States Patent [19]

McAmish

[11] Patent Number: 4,774,125

[45] Date of Patent: Sep. 27, 1988

[54] NONWOVEN FABRIC WITH IMPROVED ABRASION RESISTANCE

[75] Inventor: Larry H. McAmish, Arlington, Tex.

[73] Assignee: Surgikos, Inc., Arlington, Tex.

[21] Appl. No.: 65,626

[22] Filed: Jun. 22, 1987

Related U.S. Application Data

[63] Continuation of Ser. No. 782,845, Oct. 2, 1985, abandoned.

[51] Int. Cl.[4] ..... B32B 27/14

[52] U.S. Cl. ..... 428/198; 156/219; 156/290; 156/296; 156/244.11; 428/172; 428/284; 428/286; 428/297; 428/298; 428/219; 428/340; 428/903

[58] Field of Search ..... 428/903, 172, 198, 284, 428/286, 297, 298, 219, 340; 156/219, 290, 296, 244.11

[56] References Cited

U.S. PATENT DOCUMENTS

| | | | |
|---|---|---|---|
| 2,988,469 | 6/1961 | Watson | 264/12 |
| 3,795,571 | 3/1974 | Prentice | 428/198 |
| 4,355,066 | 10/1982 | Newman | 428/903 |
| 4,622,259 | 11/1986 | McAmish et al. | 428/913 |
| 4,652,487 | 3/1987 | Morman | 428/138 |
| 4,657,802 | 4/1987 | Morman | 428/152 |

*Primary Examiner*—James J. Bell

[57] ABSTRACT

A melt-blown microfiber fabric having improved surface abrasion resistance is disclosed, having a surface veneer of melt-blown fibers with an average fiber diameter of greater than 8 microns and in which 75% of the fibers have a fiber diameter of at least 7 microns and a wet and dry abrasion resistance of greater than 15 cycles to pill.

14 Claims, 1 Drawing Sheet

10
12
14
15
2
16
2
26
11
13
14
15
16
23
22
24
25

14
15
30
16
20
19
32
28
35
27
27
29
17
35
20
19
33
28
31
16
14
15

16
27
32
17
33
27
16

16
27
32
17
33
27
16

NONWOVEN FABRIC WITH IMPROVED ABRASION RESISTANCE

This application is a continuation of application Ser. No. 782,845, filed Oct. 2, 1985, now abandoned.

FIELD OF THE INVENTION

The present invention relates to improved nonwoven fabrics made of microfiber webs, characterized by high surface abrasion resistance, and especially suitable for use as medical fabrics.

BACKGROUND OF THE INVENTION

The present invention is directed to nonwoven fabrics and particularly to medical fabrics. The term "medical fabric", as used herein, refers to a fabric which may be used in surgical drapes, surgical gowns, instrument wraps, or the like. Such medical fabrics have certain required properties to insure that they will perform properly for the intended use. These properties include strength, the capability of resisting water or other liquid penetration. often referred to as strike-through resistance, breathability, softness, drape, sterilizability, and bacterial barrier properties.

The use of microfiber webs in applications where barrier properties are desired is known in the prior art. Microfibers are fibers having a diameter of from less than 1 micron to about 10 microns. Microfiber webs are often referred to as melt-blown webs as they are usually made by a melt blowing process. It is generally recognized that the use of relatively small diameter fibers in a fabric structure should allow the achievement of high repellency or filtration properties without undue compromise of beneathability. Microfiber web fabrics made heretofore. and intended for use as medical fabrics, have been composites of microfiber webs laminated or otherwise bonded to spunbonded thermoplastic fiber webs, or films, or other reinforcing webs which provide the requisite strength.

Another important property for both nonwoven fabrics and medical fabrics is abrasion resistance. Resistance to surface abrasion effects not only the performance of a fabric but may also effect the aesthetics of a fabric. For example, linting of broken surface fibers is particularly undesirable in medical fabrics. In addition, surface abrasion can affect the strike-through resistance and bacterial barrier properties of a medical fabric. Linting, as well as pilling or clumping of surface fibers is also unacceptable for many wipe applications. An outer layer of a spunbonded fiber web, film or other reinforcing web has been used to develop surface abrasion resistance in melt-blown fiber products.

U.S. Pat. No. 4,041,203 discloses a nonwoven fabric made by combining microfiber webs and spunbonded webs to produce a medical fabric having good drape, breathability, water repellency, and surface abrasion resistance.

U.S. Pat. No. 4,196,245 discloses combinations of melt-blown or microfine fibers with apertured films or with apertured films and spunbonded fabrics. Again, the apertured film and the spunbonded fabric are the components in the finished, nonwoven fabric which provide the strength and surface stability to the fabric.

U.K. Patent Application No. 2,132,939 discloses a melt-blown fabric laminate suitable as a medical fabric, comprising a melt-blown microfiber web welded at localized points to a nonwoven reinforcing web of discontinuous fibers, such as an air laid or wet laid web of staple fibers.

While the above-mentioned fabrics have the potential to achieve a better balance of repellency and breathability compared to other prior art technologies not using microfibers, the addition of surface reinforcing layers of relatively large diameter fibers limits their advantages. U.S. Pat. No. 4,436,780 to Hotchkiss et al. describes a melt-blown wipe with low linting, reduced streaking and improved absorbency, comprising a middle layer of melt-blown fibers and on either side thereof, a spunbond layer.

In order to improve surface abrasion resistance and reduce lint of melt-blown webs generally, it is also known to compact the web to a high degree, or add or increase the level of binder. Copending application, now U.S. Pat. No. 4,622,259, provides a medical fabric from an unreinforced web or webs of microfine fibers. The fabric is unreinforced in that it need not be laminated or bonded to another type of web or film to provide adequate strength to be used in medical applications. The fabric also achieves a balance of repellency, strength, breathability and other aesthetics superior to prior art fabrics. However, as described in the application, in order to render the fabric especially effective for use in applications requiring high abrasion resistance, a small amount of chemical binder may be applied to the surface of the fabric.

U.K. Patent Application No. 2,104,562 discloses surface heating of a melt-blown fabric to give it an anti-linting finish. It is also generally known to use a level of heat and compaction, e.g., embossing, of a microfiber web to improve abrasion resistance.

The above fabrics which have reinforcing webs have to be assembled using two or more web forming technologies, resulting in increased process complexity and cost. Furthermore, the bonding of relatively conventional fibrous webs to the microfibers, the compaction or the addition of binder to a microfiber web can result in stiff fabrics, especially where high strength is desired.

BRIEF SUMMARY OF THE INVENTION

The present invention provides a melt-blown microfiber embossed web with improved wet and dry surface abrasion resistance of greater than 15 cycles to pill. The abrasion resistance is achieved without the use of additional binder and does not sacrifice the drape or hand of the material.

According to the present invention, surface abrasion resistance is achieved with the addition of a surface veneer of melt-blown fibers having an average fiber diameter of greater than 8 microns, and in which 75% of the fibers have a fiber diameter of at least 7 microns. The surface veneer may be bonded to a melt-blown core web, such as that described in copending application now U.S. Pat. No. 4,622,259, by heat embossing or other methods. The bonding of the veneer to the core web and heat embossing of the core web may be achieved in one processing step. In addition, when the core web and veneer web are produced in one fabric making step using multiple dies, the veneer may be produced atop the core web, with high initial autogenous bonding, eliminating the need to bond the veneer to the core web.

By eliminating the need for additional binder, the present invention provides a method for making melt-blown microfiber web without the additional processing steps of adding binder and drying and/or curing the binder. Also, potential heat damage during binder curing or drying which may adversely affect the drape and hand of a fabric is eliminated. Stiffening of the fabric through the use of binder solution is also eliminated, thereby permitting adjustment of processing conditions of the core web to maximize other properties.

In addition, the use of a surface veneer of melt-blown fibers provides a fabric with a combination of drape and surface abrasion resistance which cannot be achieved with the addition of binder materials. The use of melt-blown fibers to form the surface veneer also provides economic advantages and minimizes the technologies necessary to produce the fabric.

Thus, the present invention provides an improved melt-blown or microfiber fabric with improved surface abrasion resistance but without binder, which may be used as a medical fabric or wipe or in other applications where high surface abrasion resistance is required. In a preferred embodiment, the fabric of the present invention comprises an unreinforced, melt-blown, microfiber fabric with improved surface abrasion resistance, e.g.. greater than 15 cycles to pill, suitable for use as a medical fabric, said fabric having a minimum grab tensile strength to weight ratio greater than 0.8 newtons (N) per gram per square meter, and a minimum Elmendorf tear strength to weight ratio greater than 0.04N per gram per square meter. In a most preferred embodiment of the present invention, the embossed unreinforced fabrics described above have a wet abrasion resistance of at least 30 cycles to pill, and a dry abrasion resistance of at least 40 cycles to pill. These properties are achieved while also obtaining the properties of repellency, air permeability and especially drapability that are desired for the use of the fabric in medical applications.

DETAILED DESCRIPTION OF THE INVENTION

In its broadest aspect, the present invention comprises providing a surface veneer of melt-blown fibers to a melt-blown microfiber web said surface veneer having an average fiber diameter of greater than 8 microns in which at least 75% of the fibers have a diameter of at least 7 microns. For most fabric applications the surface veneer will be laminated to the remainder of web. e.g., by emboss bonding, or combined by other known methods. Thus, the surface veneer may be formed separately from the remainder of the web and thermally bonded thereto, preferably at discrete intermittent bond regions. Alternatively, the veneer may be formed with high initial autogenous bonding atop the remainder of the web eliminating the need to bond the veneer to the remainder of the web, though thermal embossing the fabric may be preferred. The fabrics of the present invention exhibit improved wet and dry surface abrasion resistance and are especially applicable for use as wipes or medical fabrics.

Figure 1:
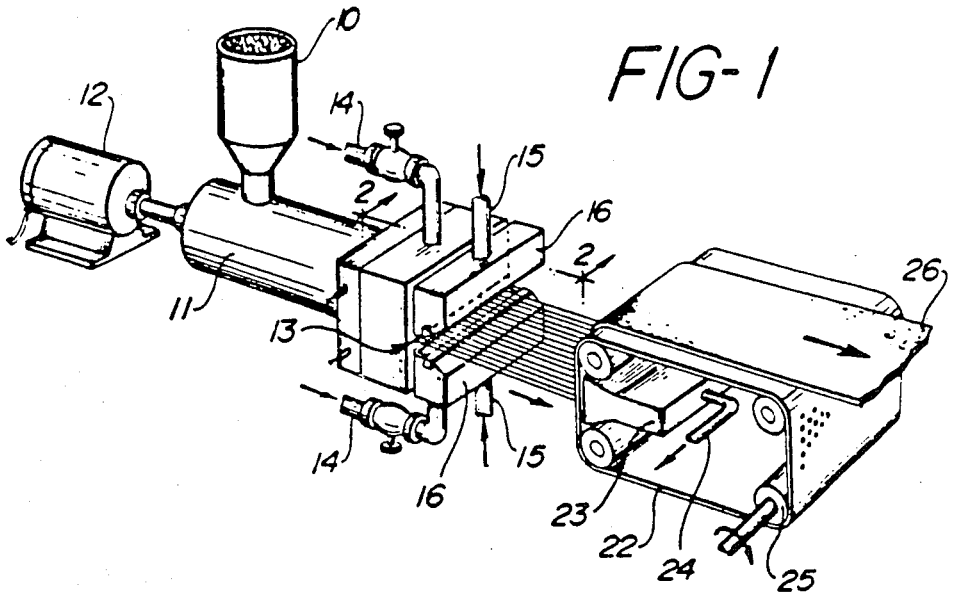
FIG. 1 is an isometric view of the melt-blowing process.

In its broadest aspects, the process of the present invention may be carried out on conventional melt-blowing equipment which has been modified to provide high velocity secondary air, such as that shown in co-pending application, now U.S. Pat. No. 4,622,259 and shown in FIG. 1. In the apparatus shown, a thermoplastic resin in the form of pellets or granules, is fed into a hopper 10. The pellets are then introduced into the extruder 11 in which the temperature is controlled through multiple heating zones to raise the temperature of the resin above its melting point. The extruder is driven by a motor 12 which moves the resin through the heating zones of the extruder and into the die 13. The die 13 may also have multiple heating zones.

Figure 2:
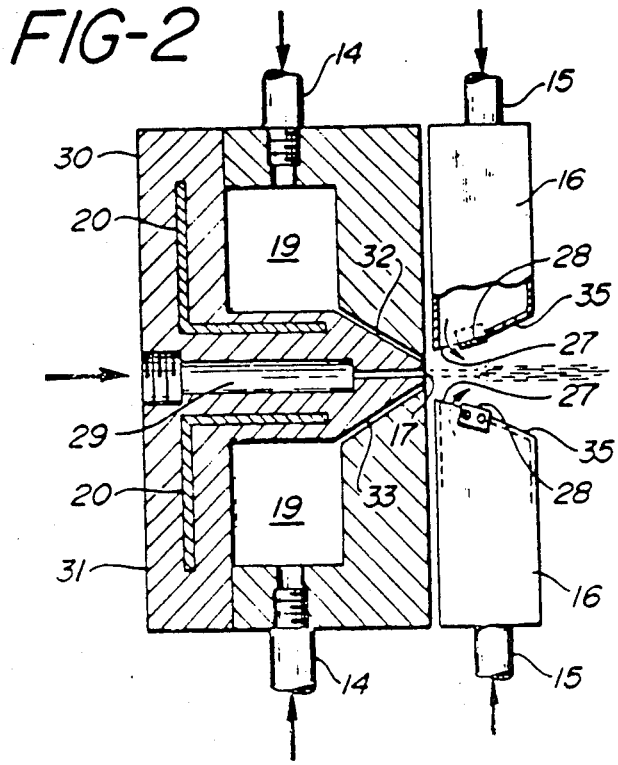
FIG. 2 is a cross-sectional view of the placement of the die and the placement of the secondary air source.

As shown in FIG. 2, the resin passes from the extruder into a heater chamber 29 which is between the upper and lower die plates 30 and 31. The upper and lower die plates are heated by heaters 20 to raise the temperature of die and the resin in the chamber 29 to the desired level. The resin is then forced through a plurality of minute orifices 17 in the face of the die. Conventionally, there are about 12 orifices per centimeter of width of the die.

An inert hot gas, usually air, is forced into the die through lines 14 into gas chamber 19. The heated gas, known as primary air, then flows to gas slots 32 and 33 which are located in either side of the resin orifices 17. The hot gas attenuates the resin into fibers as the resin passes out of the orifices 17. The width of the slot 32 or 33 is referred to as the air gap. The fibers are directed by the hot gas onto a web forming foraminous conveyor or receiver 22 to form a mat or web 26. It is usual to employ a vacuum box 23 attached to a suitable vacuum line 24 to assist in the collection of the fibers. The conveyor 22 is driven around rollers 25 so as to form a web continuously.

Figure 3:
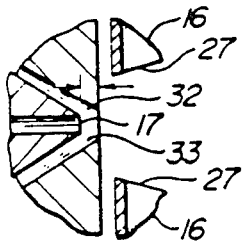
FIG. 3 is a detailed fragmentary view of the extrusion die illustrating negative set back.
Figure 4:
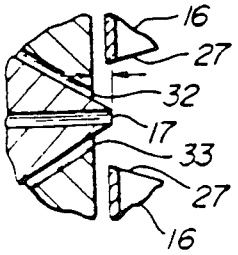
FIG. 4 is a detailed fragmentary view of the extrusion die illustrating positive set back.

The outlets of the orifices 17 and the gas slots 32 and 33 may be in the same plane or may be offset. FIG. 3 shows the orifice 17 terminating inward of the face of the die and the slots 32 and 33. This arrangement is referred to as negative setback. The setback dimension is shown by the space between the arrows in FIG. 3. Positive setback is illustrated in FIG. 4. The outlet of the orifice 17 terminates outward of the face of the die and the slots 32 and 33. The setback dimension is shown by the space between the arrows in FIG. 4. A negative setback is preferred in the present process as it allows greater flexibility in setting the air gap without adversely effecting the quality of the web produced.

The fabrics of the present invention comprise at least one surface veneer and a core web. Preferably, the fabric comprises a core web and surface veneers on both surfaces of the core web. As used herein, veneer means a web of fibers having a basis weight no greater than 50% of the total weight of the fabric. Preferably, the basis weight of the veneer web is about 25% of the weight of the total fabric. and most preferably, between about 15% to 25% of the total weight of the fabric. The veneer web(s) may be formed separately from the core web and then combined therewith in a face-to-face relationship. When using this method, each veneer web must have a basis weight of about 6 $g/m^2$ to facilitate handling of the web to combine it with the core web. Alternatively, the core and veneer webs may be formed atop one another e.g., by depositing the core web fibers atop the veneer web disposed on the conveyor 22 and acting as the receiver for the fibers of the core web. In this preferred method of the present invention, a veneer web of about 3 g/m$^2$ may be deposited on the conveyor and form the receiver for the core web and/or a veneer web of about 3 g/m$^2$ may be deposited on the core web acting as a receiver. Alternatively, the fiber of the veneer webs may be deposited on both surfaces of the core web in separate web forming steps. Thereafter the core web and veneer web(s) may be laminated, e.g., by heat embossing. When depositing the veneer web(s) on the core web, if the veneer web(s) is formed under conditions which provide high initial interfiber or autogenous bonding, including high die temperature, no secondary air and a short forming distance, (as described more fully below) it may not be necessary to laminate the veneer web(s) to the core as, e.g., by heat embossing, nor to emboss the veneer. The core web may be embossed or unembossed prior to the deposition of the fibers of the veneer web thereon. The embossed fabric laminates of the present invention exhibit a wet surface abrasion resistance of at least 30 cycles to pill and a dry surface abrasion resistance of at least 40 cycles to pill.

As stated hereinbelow, it is possible to form the fabric of the present invention according to the above methods with only one melt-blown die by increasing the polymer throughput and reducing the primary air to form the veneer web(s). In a most preferred method of making the fabrics of the present invention, multiple dies are used.

In its most preferred aspect the present invention comprises an improved unreinforced melt-blown microfiber fabric for use as a medical fabric, said fabric having a minimum grab tensile strength to weight ratio of at least 0.8N per gram per square meter and a minimum Elmendorf tear strength to weight ratio of at least 0.04N per gram per square meter. The invention will now be further described in relation to this preferred embodiment.

The requirements for medical grade fabrics are quite demanding. The fabric must have sufficient strength to resist tearing or pulling apart during normal use, for instance, in an operating room environment. This is especially true for fabrics that are to be used for operating room apparel. such as surgical gowns, or scrub suits, or for surgical drapes. One measure of the strength of a nonwoven fabric is the grab tensile strength. The grab tensile strength is generally the load necessary to pull apart or break a 10 cm wide sample of the fabric.

The test for grab tensile strength of nonwoven fabrics is described in ASTM D1117. Nonwoven medical fabrics must also be resistant to tearing. The tearing strength or resistance is generally measured by the Elmendorf Tear Test as described in ASTM D1117. While the grab tensile strengths, measured in the weakest, normally cross machine direction. of the least strong commercially used medical fabrics are in the range of 45 newtons (N) with tear strengths in the weakest direction of approximately 2N, at these strength levels, fabric failure can occur and it is generally desired to achieve higher strength levels. Grab tensile strength levels of approximately 65N and above and tear resistance levels of approximately 6N and above would allow a particular medical fabric to be used in a wider range of applications. The preferred fabrics of the present invention have a high strength to weight ratio, such that at desirable weights, both grab tensile and tear strengths higher than the above values can be achieved, and generally have basis weights in the range of 14 to 85 g/m$^2$.

Medical fabrics must also be repellent to fluids including blood, that are commonly encountered in hospital operating rooms. Since these fluids offer a convenient vehicle for microorganisms to be transported from one location to another, repellency is a critical functional attribute of medical fabrics. A measure of repellency that is influenced primarily by the pore structure of a fabric is the "hydrostatic head" test. AATCC 127-1977. The hydrostatic head test measures the pressure, in units of height of a column of water, necessary to penetrate a given sample of fabric. Since the ultimate resistance of a given fabric to liquid penetration is governed by the pore structure of the fabric, the hydrostatic head test is an effective method to assess the inherent repellent attributes of a medical fabric. Nonwoven medical fabrics which do not include impermeable films or microfiber webs generally possess hydrostatic head values between 20 to 30 cm of water. It is generally recognized that these values are not optimum for gowns and drapes. espeolaIIy for those situations in which the risk of infection is high. Values of 40 cm or greater are desirable. Unfortunately, prior art disposable fabrics which possess high hydrostatic head values are associated with lo breathability or relatively low strength. The fabrics of the present invention can attain a high level of fluid repellency.

The breathability of medical fabrics is also a desirable property. This is especially true if the fabrics are to be used for wearing apparel. The breathability of fabrics is related to both the rate of moisture vapor transmission (MVTR) and air permeability. Since most fibrous webs used for medical fabrics possess reasonably high levels of MVTR, the measurement of air permeability is an appropriate discriminating quantitative test of breathability.

Generally the more open the structure of a fabric, the higher its air permeability. Thus, highly compacted, dense webs with very small pore structures result in fabrics with poor air permeability and are consequently perceived to have poor breathability. An increase in the weight of a given fabric would also decrease its air permeability. A measure of air permeability is the Frazier air porosity test. ASTM D737. Medical garments made of fabrics with Frazier air porosity below 8 cubic meters per minute per square meter of fabric would tend to be uncomfortable when worn for any length of time. The fabrics of the present invention achieve good breathability without sacrifice of repellency or strength.

Medical fabrics must also have good drapability, which may be measured by various methods including the Cusick drape test. In the Cusick drape test, a circular tabric sample is held ooncentrically between horizontal discs which are smaller than the fabric sample. The fabric is allowed to drape into folds around the lower of the discs. The shadow of the draped sample is projected onto an annular ring of paper of the same size as the unsupported portion of the fabric sample. The outline of the shadow is traced onto the annular ring of paper. The mass of the annular ring of paper is determined. The paper is then cut along the trace of the shadow, and the mass of the inner portion of the ring which represents the shadow is determined. The drape coefficient is the mass of the inner ring divided by the mass of the annular ring times 100. The lower the drape coefficient, the more drapable the fabric. The fabrics of the present invention demonstrate high drapability when measured by this method. Drapability correlates well with softness and flexibility.

In addition to the above characteristics, medical grade fabrics must have anti-static properties and fire retardancy. The fabrics should also possess good resistance to abrasion, and not shed small fibrous particles, generally referred to as lint.

In addition to the characteristics mentioned above, the preferred fabric of the present invention differs from prior art melt-blown webs in that the average length of the individual fibers in the web is greater than the average length of the fibers in prior art webs. The average fiber length in the core webs is greater than 10 cm, preferably greater than 20 cm and most preferably in the range of 25 to 50 cm. Also the average diameter of the fibers in the core web should be no greater than 7 microns. The distribution of the fiber diameters is such that at least 80% of the fibers have a diameter no greater than 7 microns and preferably at least 90% of the fibers have a diameter no greater than 7 microns.

In the description of the present invention the term "web" refers to the unbonded web formed by the melt blowing process. The term "fabric" refers to the web after it is bonded by heat embossing or other means.

The preferred fabric of the present invention comprises an unreinforced melt-blown embossed fabric having a core web of average fiber length greater than 10 centimeters and in which at least 80% of the fibers have a diameter of 7 microns or less, and a surface veneer provided on one or both surfaces of the core web. said surface veneers having an average fiber diameter of greater than 8 microns, and in which 75% of the fibers have a fiber diameter of at least 7 microns.

In the process of making this preferred fabric of the present invention, the fibers of the core web are contacted by high velocity secondary air immediately after the fibers exit the die. The fibers of the surface veneer may or may not be contacted by high velocity secondary air. The secondary air is ambient air at room temperature or at outside air temperature. If desired, the secondary air can be chilled. The secondary air is forced under pressure from an appropriate source through feed lines 15 and into distributor 16 located on each side of the die. The distributors are generally as long as the face of the die. The distributors have an angled face 35 with an opening 27 adjacent the die face. The velocity of the secondary air can be controlled by increasing the pressure in feed line 15 or by the use of a baffle 28. The baffle would restrict the size of the opening 27, thereby increasing the velocity of air exiting the distribution box, at constant volume.

The present nonwoven fabric differs from prior art microfiber-containing fabrics in the utilization of the melt-blowing process to produce a surface veneer of fibers with characteristics which differ from the characteristics of the microfibers of the core web and which result in a fabric with high strength to weight ratios, good surface abrasion resistance and drape if the fibers are formed into a core web and surface veneer and thermally bonded as described herein.

In the practice of prior art melt-blown technology for fabric related applications, it is typical to produce microfibers which range in average diameter from about 1 to 10 microns. While in a given web, there may be a range of fiber diameters, it is often necessary to keep the diameters of these fibers low in order to fully exploit the advantages of microfiber structures as good filtration media. Thus, it is usual to produce webs or batts with average fiber diameters of less than 5 microns or at times even less than 2 microns. In such prior art processes, it is also typical for such fibers to be of average lengths between 5 to 10 centimeters (cm). As discussed in the review of the prior art fabrics, the webs formed from such fibers have very low strength and abrasion resistance. The tensile strength and abrasion resistance of such a web is primarily due to the bonding that occurs between fibers as they are deposited on the forming conveyor. Some degree of interfiber surface bonding can occur because in the conventional practice of melt-blown technology, the fibers may be deposited on the forming conveyor in a state in which the fibers are not completely solid. Their semi-molten surfaces can then fuse together at crossover points. This bond formation is sometimes referred to as autogenous bonding. The higher the level of autogenous bonding, the higher the integrity of the web. However, if autogenous bonding of the thermoplastic fibers is excessively high, the webs become stiff, harsh and quite brittle. The strength of such unembossed webs is furthermore not adequate for practical applications such as medical fabrics. Thermal bonding of these webs can generally improve strength and abrasion resistance. However, as discussed in previous sections, without introduction of surface reinforcing elements or binder, it has heretofore not been possible to produce melt-blown microdenier fabrics with high surface abrasion resistance, particularly for use as surgical gowns, scrub apparel and drapes.

In forming the core webs of this preferred fabric of the present invention, fibers are produced which are longer than fibers of the prior art. Fiber lengths were determined using rectangular-shaped wire forms. These forms had span lengths ranging from 5 to 50 cm in 5 cm increments. Strips of double-faced adhesive tape were applied to the wire to provide adhesive sites to collect fibers from the fiber stream. Fiber lengths were determined by first passing each wire form quickly through the fiber stream, perpendicular to the direction of flow, and at a distance closer to the location of the forming conveyor than to the melt blowing die. Average fiber lengths were then approximated on the basis of the number of individual fibers spanning the wire forms at successive span lengths. If a substantial portion of the fibers are longer than 10 cm, such that the average fiber length is at least greater than 10 cm and preferably greater than 20 cm, the webs, thus formed, can result in embossed fabrics with good strength, while maintaining other desired features of a medical fabric. Fabrics with highly desirable properties are produced when average fiber lengths are in the range of 25 to 50 cm. In order to maintain the potential of microdenier fibers to resist liquid penetration, it is necessary to keep the diameters of the fibers low. In order to develop high repellency. it is necessary for the average diameter of the fibers of the present core web to be no greater than 7 microns. At least 80% of the fibers should have diameters no greater than 7 mcrons. Preferably, at least 90% of the fibers should have diameters no greater than 7 microns. A narrow distribution of fiber diameters enhances the potential for achieving the unique balance of properties of this invention. While it is possible to produce fabrics with average fiber diameters greater than 7 microns and obtain high strength. the ultimate repellency of such a fabric would be compromised, and it would then not be feasible to produce low weight fabrics with high repellency.

When the melt-blown fibrous core web is formed in such a manner that autogenous bonding is very low and the webs have little or no integrity, the fabrics that result upon thermal embossing these webs are much stronger and possess better aesthetics than fabrics made of webs with high initial strength. That is, the weakest unembossed webs, with fiber dimensions as described above, form the strongest embossed fabrics. The higher the level of initial interfiber bonding, the stiffer and more brittle the resulting fabric, leading to poor grab and tear strengths. As autogenous bonding is reduced, the resulting fabric develops not only good strength but becomes softer and more drapable after thermal embossing. Because of the relatively low levels of web integrity, it is useful to determine the strength of the unembossed web by the strip tensile strength method, which uses a 2.54 cm-wide sample and grip facings which are also a minimum 2.54 cm wide (ASTM D1117). In prior art melt-blown fabrics the machine direction (MD) strip tensile strength of the autogenously bonded web is generally greater than 30% and frequently up to 70% or more of the strip tensile strength of the bonded fabric. That is, the potential contribution of autogenous bonding to the strength of the embossed fabric is quite high. In the fabric of the present invention the autogenous bonding of the core web contributes less than 30%, and preferably less than 10%, of the strip tensile strength of the bonded fabric.

For example, a Nylon 6 melt-blown web with a weight of approximately 50 g/m$^2$ made under prior art conditions may possess a strip tensile strength in the machine direction of between 10 to 20N. In this preferred fabric of the invention, it is necessary to keep the strip tensile strength of the unembossed core web below 10N and preferably below 5N to achieve the full benefits of the invention. In other words, when long fibers are produced and collected, in such a way that initial interfiber bonding is low, the individual fibers are stronger, and there is greater exploitation of the inherent strength of the fibers themselves.

While it is necessary to produce the fibers of the core web in such a way that initial interfiber bonding is low and 80% of the fibers have a fiber diameter of no more that 7 microns, such webs when embossed do not exhibit high surface abrasion resistance, and a chemical binder is often added to the surface of such fabrics to increase surface abrasion resistance. The addition of binder negatively impacts the drape of the fabric, therefore the amount of binder added must be kept to a minimum, and, in practice, the amount of binder which can be added while maintaining adequate drape gives only satisfactory, but not high, abrasion resistance.

In the fabric of the present invention, the use of binder and its negative impact on drape is avoided by providing the core web with a surface veneer of microfibers on one or both surfaces of the core web. The fibers of the surface veneer have an average fiber diameter of greater than 8 microns and 75% of the fibers have a fiber diameter of at least 7 microns. In addition, in a preferred embodiment. the surface veneer is formed with high initial interfiber bonding.

In summary, this preferred fabric of the present invention, in contrast to conventional melt-blown webs of the prior art, is characterized by a core web of high average fiber length, low interfiber bonding, stronger individual fibers and low fiber diameters in a relatively narrow distribution range to provide high resistance to fluid penetration, and at least one surface veneer of higher fiber diameters and, preferably, high interfiber bonding.

The method of producing the desired core web and surface veneer characteristics of this preferred fabric of the invention is based on the control of the key process variables and their interactions to achieve the desired fiber, web, and fabric properties. These process variables include extrusion temperatures, primary air flow and temperature, secondary air flow, and forming length (distance from die to receiver). The influence of these variables on the key desired web and veneer properties is described below.

For both the core web and surface veneer, individual fiber strength can be enhanced significantly if the die melt temperature, for instance, can be maintained at levels generally 10° to 35° C. below temperatures recommended for prior art processes. Generally, in the present prcoess the die melt temperature is no greater than about 75° C. above the melting point of the polymer.

In forming the core web, the velocity and temperature of the primary air, and the veoocity and temperature of the secondary air must be adjusted to achieve optimum fiber strength at zero span length for a given polymer. The high velocity secondary air employed in the present process is instrumental in increasing the time and the distance over which the fibers of the core web are attenuated adding to fiber strength. The use of secondary air in the process of producing the surface veneer fibers is not essential, and secondary air is preferably omitted in forming the preferred surface veneer with high initial interfiber bonding.

The fiber length achievable in the core web and surface veneer is influenced by the primary and secondary air velocities, the level of degradation of the polymer and, of critical importance, air flow uniformity. It is important to maintain a high degree of air and fiber flow uniformity, avoiding large amplitude turbulence, vortices, streaks, and other flow irregularities. Introduction of high velocity secondary air may serve to control the air/fiber stream by cooling and maintaining molecular orientation of the fibers so that stronger fibers are produced that are more resistant to possible breakage caused by non-uniform air flow.

In order to deposit the fibers of the core web on the forming conveyor as a web with low strip tensile strength, the forming air and forming distance are clearly important. In the present process the forming distance is generally between 20 and 50 centimeters. First, in order for the core web to have minimal interfiber bonding, the fibers must arrive at the forming conveyor in a relatively solid state, free of surface tackiness. To allow the fibers time to solidify, it is possible to set the forming conveyor or receiver farther away from the die. However, at excessively long distances, i.e., greater than 50 cm., it is difficult to maintain good uniformity of the air/fiber stream and "roping" may occur. Roping is a phenomenon by which individual fibers get entangled with one another in the air stream to form coarse fiber bundles. Excessive roping diminishes the capacity of the resultant fabric to resist fluid penetration, and also leads to poor aesthetic attributes. A primary air flow of high uniformity enhances the opportunity to achieve good fiber attenuation and relatively long distance forming without roping.

The primary air volume is also an important factor. Sufficient air volume must be used, at a given polymer flow rate and forming length, to maintain good fiber separation in the air/fiber stream, in order to minimize the extent of roping.

The use of the secondary air system also is important in achieving low interfiber bonding in the core web without roping. As noted previously, the high velocity secondary air is effective in improving the uniformity of the air/fiber stream. Thus, it enhances the potential to increase the forming length without causing undesirable roping. Furthermore, since the secondary air is maintained at ambient temperature, or lower if desired, it can serve also to cool and solidify the fibers in a shorter time, thus obviating the need for detrimentally large forming lengths. For the secondary air system to have an influence on flow uniformity and cooling, and the rate of deceleration of the fibers, its velocity should be high enough that its flow is not completely overwhelmed by the primary air flow. In the present process, a secondary air velocity of 30 m/sec to 200 m/sec or higher is effective in providing the desired air flow characteristics. Obviously, there are various approaches and combinations of primary and secondary air flows, temperatures, and forming lengths that can be used to achieve low interfiber bonding in the unembossed core web. The specific process parameters depend on the polymer being used. the design of the die and its air systems, the production rate, and the desired product properties.

The unembossed core web or layers of unembossed core webs must be bonded to form this preferred fabric of the present invention. It has been determined to be advantageous to use thermal bonding techniques. In a most preferred method of the present invention, the core web or webs are thermally bonded and the veneer thermally bonded and laminated to the core web in one thermal embossing step. Either ultrasonic or mechanical embossing roll systems using heat and pressure may be used. For the present invention, it is preferred to use a mechanical embossing system for point bonding using an engraved roll on one side and a solid smooth roll on the other side of the fabric. In order to avoid "pinholes" in the fabric, it has also been found desirable to set a small gap, of the order of 0.01 to 0.02 mm, between the top and bottom rolls. For the intended use of the fabrics which can be produced by this invention, the total embossed area must be in the range of 5 to 30% of the total fabric surface, and preferably should be in the range of 10–20%. In the examples given to illustrate the invention, the embossed area is 18%. The embossing pattern is 0.76 mm×0.76 mm diamond pattern with 31 diamonds per square centimeter of roll surface. The particular embossing pattern employed is not critical and any pattern bonding between 5 and 30% of the fabric surface may be used.

The principles of this invention apply to any of the commercially available resins, such as polypropylene, polyethylene, polyamides, polyester or any polymer or polymer blends capable of being melt-blown. It has been found particularly advantageous to use polyamides, and particularly Nylon 6 (polycaprolactam), in order to obtain superior aesthetics low susceptibility to degradation due to cobalt irradiation, excellent balance of properties, and overall ease of processing.

As stated previously, the preferred fabrics of the present invention have a basis weight of from 14 to 85 grams per square meter. The surface veneers when separately formed, have a basis weight of from about 6 grams per square meter, and when co-formed, a basis weight of from about 3 grams per square meter. Basis weights of the surface veneers are generally no greater than 10 to 15 grams per square meter, as higher veneer base weights may require lower core web basis weights to achieve the desired overall basis weight of the fabric. The fabrics have a minimum grab tensile strength to weight ratio greater than 0.8N per gram per square meter, a minimum Elmendorf tear strength to weight ratio greater than 0.04N per gram per square meter and wet and dry surface abrasion resistance of greater than 15 cycles to pill. For disposable medical fabrics where high strength and abrasion resistance are required, the preferred fabrics have basis weights no greater than 60 grams per square meter, a minimum grab tensile strength of not less than 65N, a minimum Elmendorf tear strength not less than 6N, and dry surface abrasion resistance of at least 40 cycles to pill and a wet surface abrasion resistance of at least 30 cycles to pill.

It is to be understood that the fibers, webs or fabrics produced according to this invention can be combined in various ways, and with other fibers, webs, or fabrics possessing different characteristics to form products with specifically tailored properties.

The examples which follow are intended to clarify further the present invention, and are in no way intended to serve as the limits of the content or scope of this invention.

EXAMPLE 1

In the following example, webs 1, 2 and 3 were produced under the conditions set forth in Table I below.

TABLE I

PROCESS CONDITIONS USED TO PRODUCE MELT-BLOWN NYLON WEBS

| Process Conditions | Webs 1 | 2 | 3 |
|---|---|---|---|
| Extruder Temperature - Feed °C. | 260 | 232 | 260 |
| Extruder Temperature - Exit °C. | 275 | 275 | 300 |
| Screen/Mixer Temperature °C. | 275 | 275 | 287 |
| Die Temperature °C. | 287 | 265 | 300 |
| Primary Air Temperature °C. | 287 | 287 | 335 |
| Primary Air Velocity m/sec | 290 | 255 | 221 |
| Polymer Rate g/min-hole$^{-1}$ | 0.14 | 0.14 | 0.28 |
| Die Air Gap mm | 1.14 | 1.14 | 1.14 |
| Die Setback - Negative mm | 1.02 | 1.02 | 1.02 |
| Secondary Air Velocity m/sec | 30 | 30 | 30 |
| Basis Weight g/m$^2$ | 52 | 44 | 6 |
| Average Fiber Diameter microns | 3.6 | 4.1 | 9.8 |

Web 1 was produced under conditions similar to those set forth in copending application, now U.S. Pat. No. 4,622,259 for optimizing both barrier and strength properties in the final fabric. Web 2 was produced under modified conditions to produce a fabric with enhanced fabric strength, but with a slight loss of barrier properties, achieved by lowering the die temperature and the primary air velocity relative to web 1 conditions. Web 3 was produced by increasing the polymer throughput rate and further decreasing primary air velocity to produce a fiber layer having an average fiber diameter of 9.8 microns and in which 80% of the fibers have a fiber diameter greater than 7 microns. Additionally the die temperature was raised to increase the initial interfiber bonding of Web 3. Table II lists the physical properties of embossed fabrics made from webs 1, 2 and 3. Table III sets forth the processing conditions for producing the embossed fabrics whose physical characteristics are listed on Table II.

TABLE II

DESCRIPTION AND PHYSICAL PROPERTY CHARACTERISTICS OF THERMALLY-EMBOSSED MELT-BLOWN NYLON

| Characteristics | | Fabrics 4 | 5 | 6 | 7 |
|---|---|---|---|---|---|
| Composition | Layer 1 | Web 1 | Web 2 | Web 3 | Web 3 |
| | Layer 2 | — | — | Web 2 | Web 2 |
| | Layer 3 | — | — | — | Web 3 |
| Total Basis Weight (g/m$^2$) | | 52 | 44 | 50 | 56 |
| Grab Tensile Strength to Weight Ratio | | | | | |
| (N/g-m$^2$) | MD | 2.06 | 2.77 | 2.55 | 2.48 |
| | CD | 1.53 | 1.94 | 1.95 | 1.90 |
| Hydrostatic Pressure (cm of water) | | 49 | 36 | 39 | 39 |
| Abrasion Resistance (cycles) | | | | | |
| Side 1 | | | | | |
| Dry | to pill | 15 | 15 | 40 | 50 |
| | to fail | 100 | 100 | 100 | 100 |
| Wet | to pill | 15 | 15 | 30 | 35 |
| | to fail | 100 | 100 | 100 | 100 |
| Side 2 | | | | | |
| Dry | to pill | 15 | 15 | 15 | 50 |
| | to fail | 100 | 100 | 100 | 100 |
| Wet | to pill | 15 | 15 | 15 | 35 |
| | to fail | 100 | 100 | 100 | 100 |

TABLE III

PROCESS CONDITIONS FOR THERMAL EMBOSSING OF MELT-BLOWN NYLON

| Process Conditions | Fabrics 4 | 5 | 6 | 7 |
|---|---|---|---|---|
| Percent Embossed Area (%) | 18 | 18 | 18 | 18 |
| Oil Temperature (°C.) | | | | |
| Top Embossed Roll | 126 | 122 | 121 | 121 |
| Bottom Smooth Roll | 126 | 122 | 122 | 122 |
| Nip Pressure Between Rolls (N/cm) | 685 | 685 | 685 | 685 |
| Web Speed (m/min) | 15 | 9 | 9 | 9 |

As noted in Table II, Fabric 5 shows superior grab tensile strength than Fabric 4, but decreased barrier properties as reflected in the hydrostatic pressure. The abrasion resistance remains the same. Fabrics 6 and 7 illustrate the improved abrasion resistance achieved with the use of surface veneers of web 3. Fabrics 6 and 7 show an increasing fall off of normalized grab tensile strengths due to the incorporation of the veneer layer(s) of web 3 which, while it adds to the weight of the fabric, it does not contribute as much grab tensile per unit weight as web 2. Veneer layers of web 3 add slightly to the hydrostatic head of Fabrics 6 and 7, but add remarkable surface abrasion resistance.

The dry surface abrasion resistance was measured as follows. A sample of the fabric to be tested was placed atop a foam pad on a bottom testing plate. A 7.6 cm by 12.7 cm sample of a standard Lytron finished abrading cloth was added to a top plate and placed in contact with the fabric test sample, with the machine direction of the fabric test sample aligned with the machine direction (length) of the Lytron finished cloth. A 1.1 Kg weight was placed atop the top plate and the bottom plate rotated at a fixed speed of 1.25 revolutions per minute, each rotation of the plate being recorded as one cycle. The fabric test sample was inspected under magnification after each of the first five cycles, and at five cycle intervals thereafter. The number of cycles to pill was recorded, as well as the number of cycles to create a hole in the fabric test sample. Pilling is defined as the breaking off of fibers which start to form clumps or beads. Four samples of the fabric were tested and the average number of cycles to pill and to fabric failure was reported.

The wet surface abrasion resistance was measured under a similar testing procedure, with the following modifications; the fabric test sample, fastened to the bottom plate was wetted with 5 drops of purified water, and only a 0.2 Kg weight was placed atop the top plate.

EXAMPLE 2

In the following example webs 8, 9, 10, and 11 were produced under conditions set forth in Table IV below.

TABLE IV

PROCESS CONDITIONS USED TO PRODUCE MELT-BLOWN NYLON BASE WEBS

| | | | | |
|---|---|---|---|---|
| Extruder Temperature - Feed °C. | 246 | 232 | 232 | 260 |
| Extruder Temperature - Exit °C. | 274 | 274 | 274 | 301 |

| Process Conditions | Webs 8 | 9 | 10 | 11 |
|---|---|---|---|---|
| Screen/Mixer Temperature °C. | 274 | 274 | 274 | 301 |
| Die Temperature °C. | 274 | 265 | 265 | 301 |
| Primary Air Temperature °C. | 309 | 285 | 285 | 331 |
| Primary Air Velocity m/sec | 299 | 252 | 191 | 299 |
| Polymer Rate g/min-hole$^{-1}$ | 0.14 | 0.14 | 0.28 | 0.28 |
| Die Air Gap mm | 1.14 | 1.14 | 1.14 | 1.14 |
| Die Setback - Negative mm | 1.02 | 1.02 | 1.02 | 1.02 |
| Secondary Air Velocity m/sec | 30 | 30 | 30 | 0 |
| Basis Weight g/m$^2$ | 52 | 42 | 6 | 6 |
| Average Fiber Diameter microns | | | 8.2 | 8.8 |

The process conditions for webs 8, 9, 10 and 11 fall within the process conditions set forth in copending application. Web 8 was produced under conditions for optimizing both strength and barrier properties in the final fabric. Web 9 was produced under modified conditions to produce a fabric with enhanced fabric strength with a slight loss in barrier properties, by lowering the die temperature and primary air velocity relative to web 8 conditions. Web 10 was produced by increasing the polymer throughout rate and further decreasing the primary air velocity to produce a fiber layer having an average fiber diameter of approximately 9 microns, and in which 80% of the fibers have a fiber diameter greater than 7 microns.

The die temperature remained the same for webs 9 and 10. Web 11 was produced under conditions substantially similar to those for producing web 3 but with no secondary air so as to increase initial interfiber bonding. The die temperature for the production of web 11 was also increased over that used to produce web 10 to increase initial interfiber bonding.

Table V, below, lists the physical characteristics of embossed fabrices made from webs 8, 9, and 11 under the conditions set forth in Table III. Fabric 13 comprises Fabric 12 with 3 g/m$^2$ of primacor 4990, a 80/20 copolymer of ehtylene and acrylic acid, manufactured by the Dow Chemical Company, added to each side of the fabric.

TABLE V

DESCRIPTION AND PHYSICAL PROPERTY CHARACTERISTICS OF THERMALLY-EMBOSSED MELT-BLOWN NYLON

| Characteristics | | Fabrics 12 | 13 | 14 | 15 |
|---|---|---|---|---|---|
| Composition | Layer 1 | Web 8 | Binder | Web 10 | Web 11 |
| | Layer 2 | — | Web 8 | Web 9 | Web 9 |
| | Layer 3 | — | Binder | Web 10 | Web 11 |

TABLE V-continued

DESCRIPTION AND PHYSICAL PROPERTY CHARACTERISTICS OF THERMALLY-EMBOSSED MELT-BLOWN NYLON

| Characteristics | | Fabrics 12 | 13 | 14 | 15 |
|---|---|---|---|---|---|
| Total Basis Weight (g/m$^2$) | | 52 | 58 | 54 | 54 |
| Grab Tensile Strength (N) | | | | | |
| MD | | 94.1 | 103 | 94.0 | 108 |
| CD | | 71.7 | 71.9 | 58.9 | 69.1 |
| Hydrostatic Pressure (cm of water) | | 41 | 38 | 37 | 38 |
| Abrasion Resistance (cycles) | | | | | |
| Side 1 | | | | | |
| Dry | to Pill | 5 | 15 | 40 | 45 |
| | to fail | 100 | 100 | 100 | 100 |
| Wet | to pill | 5 | 15 | 30 | 40 |
| | to fail | 100 | 100 | 100 | 100 |
| Cusick Drape (%) | | 46 | 65 | 45 | 44 |

TABLE VI

PROCESS CONDITIONS FOR THERMAL EMBOSSING OF MELT-BLOWN NYLON WEBS

| Process Conditions | Fabrics 12 | 14 | 15 |
|---|---|---|---|
| Percent Embossed Area (%) | 18 | 18 | 18 |
| Oil Temperature (°C.) | | | |
| Top Embossed Roll | 104 | 106 | 93 |
| Bottom Smooth Roll | 97 | 99 | 95 |
| Nip Pressure Between Rolls (N/cm) | 685 | 685 | 685 |
| Web Speed (m/min) | 9 | 9 | 9 |

As shown in Table V, Fabric 13 shows an increase in surface abrasion resistance with a large increase in Cusick Drape. Further increases in binder level add-on will contribute to abrasion resistance but will continue to negatively impact the drape.

Fabric 14 exhibits far greater surface abrasion resistance than Fabric 13 with no attendant loss in drape. Fabric 15 exhibits an even greater improvement in surface abrasion resistance over that shown by Fabric 14. The increase is believed to be due to the increase in initial interfiber bonding of web 11.

Thus, it is apparent that there has been provided, in accordance with the invention, a new, unreinforced, melt-blown, microfiber fabric having enhanced surface abrasion resistance that satisfies the objects aims and advantages set forth above. While the invention has been described in conjunction with specific embodiments thereof it is evident that many alternatives, modifications and variations will be apparent to those skilled in the art in light of the above description. Accordingly, it is intended to embrace all such alternatives, modifications and variations that fall within the spirit and broad scope of the appended claims.

I claim:

1. An improved unreinforced melt-blown microfiber fabric having improved surface abrasion resistance, said fabric comprising at least one unreinforced thermoplastic melt-blown microfiber core web having a minimum grab tensile strength to weight ratio greater than 0.8N per gram per square meter and a minimum Elmendorf tear strngth to weight ratio greater than 0.04N per gram per Square meter, said core web having a basis weight in the range of 14 grams per square meter to 85 grams per square meter, and at least one unreinforced surface veneer web on said core web, said veneer web being formed of melt-blown thermoplastic fibers having an average fiber diameter of greater than 8 microns in which 75% of the fibers have a diameter of at least 7 microns, having a wet and dry surface abrasion resistance of greater a than 15 cycles to pill, and having a basis weight in the range of 3 grams per square meter to 10 grams per square meter, said at least one veneer web being directly contiguous to said at least one core web.

2. The fabric of claim 1 in which the fabric is thermally embossed at intermittent discrete bond regions which occupy between 5 and 30% of the surface of the fabric.

3. The fabric of claim 1 having a wet abrasion resistance to pill of at least 30 cycles and a dry abrasion resistance to pill of at least 40 cycles.

4. The fabric of claim 3 wherein the basis weight is no greater than 60 g/m$^2$ and the minimum grab tensile strength is not less than 65N and the minimum Elmendorf tear strength is not less than 6N.

5. An improved unreinforced melt-blown microfiber fabric as in claim 1 wherein said surface veneer has an average fiber diameter of about 9 microns.

6. An improved unreinforced melt-blown fabric having improved abrasion resistance, said fabric comprising at least one unreinforced thermoplastic core web in which at least 80% of the fibers have a diameter of 7 microns or less and in which the autogenous bonding of the fibers contribute no more than 30% of the strip tensile strength of the fabric, and at least one unreinforced surface veneer web on said core web, said surface venner web being formed of melt-blown thermoplastic fibers having an average fiber diameter of greater than 8 microns and in which 75% of said fibers have a diameter of at least 7 microns and having a basis weight in the range of 3 grams per square meter to 10 grams per square meter, said fabric being thermally emobossed at intermittent discrete bond regions which occupy between 5 and 30% of the surface of the fabric, said core web having a minimum grab tensile strength to weight ratio greater than 0.8N per gram per square meter and an Elmendorf tear strength to weight ratio greater than 0.04N per gram per square meter, and said fabric having a wet surface abrasion resistance of at least 30 cycles to pill and a dry surface abrasion resistance of at least 40 cycles to pill, said at least one veneer web being directly contigous to said at least one core web.

7. An improved unreinforced melt-blown fabric as in claim 6 wherein said surface veneer has an average fiber diameter of about 9 microns.

8. A method of producing a melt-blown microfiber fabric having improved abrasion resistance comprising:

(1) forming at least one core web of thermoplastic melt-blown microfibers having a minimum grab tensile strength to weight ratio greater than 0.8N per gram per square meter, a minimum Elmendorf tear strength to weight ratio greater than 0.04N per gram per square meter, and a basis weight in the range of 14 grams per square meter to 85 grams per square meter, (2) forming at least one unreinforced surface veneer web of melt-blown thermoplastic fibers on said core web, said veneer web having high initial autogenous bonding and an average fiber diameter of greater than 8 microns, in which 75% of the fibers have a fiber diameter of at least 7 microns, said veneer web having a basis weight in the range of 3 grams per square meter to 10 grams per square meter and a wet and dry surface abrasion resistance greater than 15 cycles to pill, (3) said at least one veneer web being directly contiguous to said at least one core web.

9. A method of producing a melt-blown microfiber fabric as in claim 8 wherein said veneer web has an average fiber diameter of about 9 microns.

10. The method of claim 8 further comprising thermally embossing said laminate at discrete intermittent bond regions.

11. A method of producing an unreinforced microfiber fabric having improved surface abrasion resistance wherein a fiber-forming thermoplastic polymer resin in molten form is forced through a row of orifices in a heated nozzle into a stream of inert gas to attenuate the resin into fibers, the fibers are collected on a receiver to form a web, and the web is thermally bonded to form a fabric comprising:

(a) at a first heated nozzle, maintaining the polymer melt temperature at a level which minimizes molecular degradation, controlling the primary air velocity, volume and temperature, polymer resin throughput and exit temperature to produce a first layer of thermoplastic fibers having an average fiber diameter of greater than 8 microns, and in which 75% of the fibers have a fiber diameter of at least 7 microns, collecting the fibers on a receiver at a forming distance to form a first unreinforced surface veneer web with good interfiber bonding and having a basis weight in the range of 3 grams per square meter to 10 grams per square meter and a wet and dry surface abrasion resistance of greater than 15 cycles to pill;

(b) at a second heated nozzle, maintaining the polymer melt temperature at a level which minimizes molecular degradation, controlling the primary air velocity, volume and temperature to produce thermoplastic fibers at least 80% of which have a diameter of 7 microns or less and having an average length of more than 10 centimeters, introducing a highly uniform high velocity secondary air stream in quantities sufficient to cool the fibers and maintain good fiber separation, collecting the fibers at a forming distance to form a core web with low interfiber bonding, prior to embossing the web to form a fabric, and collecting the fibers of said core web on said first surface veneer web such that said veneer web is directly contiguous to said core web.

12. The method of claim 11 further comprising:

(c) at a third heated nozzle producing a second surface veneer web of fibers similar to said first veneer web and collecting said second surface veneer web on the exposed surface of said core web.

13. A method of producing an unreinforced microfiber embossed fabric as in claim 11 or 12 wherein said veneer webs have an average fiber diameter of about 9 microns.

14. The method of claim 11 or 12 further comprising thermally embossing said webs.

* * * * *